US008938884B2

(12) United States Patent
Kammer

(10) Patent No.: US 8,938,884 B2
(45) Date of Patent: Jan. 27, 2015

(54) ELECTRIC HAIR GROOMING APPLIANCE INCLUDING TOUCHSCREEN

(75) Inventor: Carl Gottfried Kammer, Middleton, WI (US)

(73) Assignee: Spectrum Brands, Inc., Middleton, WI (US)

( * ) Notice: Subject to any disclaimer, the term of this patent is extended or adjusted under 35 U.S.C. 154(b) by 491 days.

(21) Appl. No.: 13/051,069

(22) Filed: Mar. 18, 2011

(65) Prior Publication Data

US 2012/0233866 A1 Sep. 20, 2012

(51) Int. Cl.
*B26B 19/20* (2006.01)
*B26B 19/38* (2006.01)

(52) U.S. Cl.
CPC ..... *B26B 19/388* (2013.01); *B26B 19/3853* (2013.01); *B26B 19/3886* (2013.01)
USPC ..... 30/201; 30/233.5

(58) Field of Classification Search
USPC ..... 30/34.05, 201, 233.5
See application file for complete search history.

(56) References Cited

U.S. PATENT DOCUMENTS

| | | | | |
|---|---|---|---|---|
| 1,988,199 | A | | 1/1935 | Greco et al. |
| 2,103,418 | A | * | 12/1937 | Hagebeuker ..... 30/202 |
| 2,214,069 | A | | 9/1940 | Sikora |
| 2,593,168 | A | | 4/1952 | Monyhan |
| 2,809,425 | A | | 10/1957 | Tettis |
| 3,149,418 | A | | 9/1964 | Milbourne |
| 3,264,735 | A | | 8/1966 | Du Charme |
| 3,287,805 | A | | 11/1966 | Du Charme |
| 3,387,367 | A | | 6/1968 | Merzon |
| 3,918,154 | A | | 11/1975 | Pagani |
| 4,085,503 | A | | 4/1978 | Beck et al. |
| 5,498,914 | A | | 3/1996 | De Boer |
| 5,659,957 | A | | 8/1997 | Fujita |
| 5,898,999 | A | | 5/1999 | Chaouachi et al. |
| 5,979,060 | A | | 11/1999 | Holzbauer et al. |
| 6,279,234 | B1 | | 8/2001 | Chaouachi et al. |
| 6,393,718 | B1 | | 5/2002 | Harris et al. |
| 6,708,408 | B2 | | 3/2004 | Orloff |
| 6,928,235 | B2 | | 8/2005 | Pollack |
| D517,242 | S | | 3/2006 | Goetschi et al. |

(Continued)

FOREIGN PATENT DOCUMENTS

| | | | |
|---|---|---|---|
| CN | 201056003 | Y | 5/2008 |
| CN | 201161430 | Y | 12/2008 |

(Continued)

OTHER PUBLICATIONS

Partial European Search Report Application No. 12160136.-2313; Jun. 25, 2012; 8 pages.

(Continued)

*Primary Examiner* — Stephen Choi
(74) *Attorney, Agent, or Firm* — Armstrong Teasdale LLP

(57) ABSTRACT

An electric hair grooming appliance is configured to have one or more operations to facilitate grooming of hair. The electric hair grooming appliance includes a control circuit, and a touchscreen for receiving one or more inputs from a user and to facilitate communication between the user and the control circuit. The touchscreen is configured to send one or more command signals to the control circuit in response to receiving the one or more inputs from the user. The control circuit is configured to control one or more operations of the electric hair grooming appliance in response to receiving one or more of the command signals.

7 Claims, 10 Drawing Sheets

(56) References Cited

U.S. PATENT DOCUMENTS

| | | | | |
|---|---|---|---|---|
| 7,248,892 | B2 | 7/2007 | White et al. | |
| 7,313,422 | B2 | 12/2007 | White et al. | |
| 7,373,170 | B2 | 5/2008 | White et al. | |
| 7,376,439 | B2 | 5/2008 | White et al. | |
| 7,392,059 | B2 | 6/2008 | White et al. | |
| 7,411,511 | B2 | 8/2008 | Kennish et al. | |
| 7,466,040 | B2 | 12/2008 | Bruwer | |
| 7,509,743 | B2 | 3/2009 | Oh | |
| 7,698,822 | B2 | 4/2010 | Kostner et al. | |
| 7,699,058 | B1 | 4/2010 | Jay | |
| 7,755,219 | B2 | 7/2010 | Bruwer | |
| 7,791,490 | B2 | 9/2010 | Kennish et al. | |
| 7,830,160 | B2 | 11/2010 | Philipp | |
| 7,915,765 | B2 | 3/2011 | Bruwer | |
| 7,916,834 | B2 | 3/2011 | Piorek et al. | |
| 7,992,307 | B2 | 8/2011 | Smal | |
| 7,999,686 | B2 | 8/2011 | Kennish et al. | |
| 8,028,708 | B2 | 10/2011 | Molema et al. | |
| 8,341,846 | B1 * | 1/2013 | Holmes | 30/43.1 |
| 2003/0204956 | A1 | 11/2003 | Chan | |
| 2004/0237308 | A1 | 12/2004 | Mitchell et al. | |
| 2005/0011533 | A1 | 1/2005 | Ruben | |
| 2005/0076931 | A1 | 4/2005 | Leung et al. | |
| 2005/0098192 | A1 | 5/2005 | Cafaro | |
| 2005/0246902 | A1 * | 11/2005 | Poran | 30/201 |
| 2006/0107529 | A1 * | 5/2006 | Kostner et al. | 30/43 |
| 2006/0196057 | A1 * | 9/2006 | So | 30/322 |
| 2006/0283022 | A1 | 12/2006 | Oh | |
| 2007/0028942 | A1 | 2/2007 | Leung | |
| 2007/0213742 | A1 | 9/2007 | Callahan | |
| 2008/0109973 | A1 | 5/2008 | Farrell et al. | |
| 2008/0163495 | A1 | 7/2008 | Smal | |
| 2008/0189951 | A1 * | 8/2008 | Molema et al. | 30/41 |
| 2008/0220752 | A1 * | 9/2008 | Forstall et al. | 455/415 |
| 2009/0038639 | A1 | 2/2009 | Yetukuri et al. | |
| 2009/0084396 | A1 | 4/2009 | Jerome et al. | |
| 2009/0143914 | A1 | 6/2009 | Cook et al. | |
| 2009/0187676 | A1 * | 7/2009 | Griffin et al. | 710/14 |
| 2010/0083508 | A1 | 4/2010 | Cheng | |
| 2010/0186234 | A1 | 7/2010 | Binder | |
| 2010/0281636 | A1 | 11/2010 | Ortins et al. | |
| 2011/0107604 | A1 | 5/2011 | Julemont | |
| 2011/0120491 | A1 | 5/2011 | You | |
| 2011/0139167 | A1 | 6/2011 | Li et al. | |
| 2011/0142200 | A1 | 6/2011 | Piorek et al. | |

FOREIGN PATENT DOCUMENTS

| | | | |
|---|---|---|---|
| DE | 3800966 | A1 | 7/1989 |
| EP | 0484795 | A1 | 5/1992 |
| EP | 0928670 | A1 * | 7/1999 |
| EP | 1510305 | A1 | 3/2005 |
| EP | 1612007 | A1 | 1/2006 |
| EP | 1710055 | A1 | 10/2006 |
| EP | 1880811 | A1 | 1/2008 |
| EP | 2108489 | A1 | 10/2009 |
| GB | 2267151 | A | 11/1993 |
| JP | 2000505685 | A | 5/2000 |
| JP | 2001334077 | A | 12/2001 |
| JP | 2008544823 | A | 12/2008 |
| WO | 9825735 | A1 | 6/1998 |
| WO | 2006100627 | A1 | 9/2006 |
| WO | 2007006106 | A1 | 1/2007 |
| WO | 2009124822 | A1 | 10/2009 |
| WO | 2010091882 | A1 | 8/2010 |
| WO | 2011098159 | A1 | 8/2011 |

OTHER PUBLICATIONS

Extended European Search Report dated Oct. 12, 2012 for Application No. 12160136.3-2313/2500153; 10 pages.

Partial European Search Report App. No. 14175580.1-1656 dated Sep. 10, 2014, 8 pages.

* cited by examiner

ELECTRIC HAIR GROOMING APPLIANCE INCLUDING TOUCHSCREEN

FIELD OF THE DISCLOSURE

The present disclosure relates generally to an electric hair grooming appliance, and more particularly to an electric hair grooming appliance including a touchscreen.

BACKGROUND OF THE DISCLOSURE

Many different types of electric hair grooming appliances are available for use in grooming hair. For example, such electric hair grooming appliances include curling irons, flat irons (which are also sometimes referred to as heated tongs or hair straighteners), blow dryers, hair setters (also known as hot rollers or curlers), and electric hair removers, such as foil shavers, rotary shavers, trimmers, clippers, and epilators.

Most electric hair grooming appliances include mechanical controls, such as buttons and knobs, to allow a user to control certain operations of the electric grooming appliance. These mechanical controls may be difficult to use for some users, particularly for users suffering from arthritis and other physical ailments of their hands. Moreover, the bulkiness of the mechanical controls limits the functions and operations of the hair grooming appliances that can be controlled by the user.

SUMMARY

In one aspect, an electric, handheld hair grooming appliance generally comprises a housing, and at least one hair grooming device carried by the housing and adapted to facilitate grooming of hair. The at least one hair grooming device is adapted to perform an operation using electrical energy applied thereto. A control circuit is in the housing and in communication with the at least one hair grooming device. A touchscreen is on at least one of the at least one hair grooming device and the housing for receiving at least one input from a user and to facilitate communication between the user and the control circuit. The touchscreen is configured to send at least one command signal to the control circuit in response to receiving said at least one input from the user. The control circuit is configured to control the operation of the at least one hair grooming device in response to receiving the at least one command signal.

In another aspect, a method of controlling an operation of an electric hair grooming appliance generally comprises receiving an input using a touchscreen of the electric hair grooming appliance. The input corresponds to a desired setting of at least one operating parameter of the appliance. A command signal is sent from the touchscreen to a control circuit of the electric hair grooming appliance in response to receiving the input. The operation of the electric hair grooming appliance is controlled using the control circuit in response to receiving the command signal.

In yet another aspect, an electric hair grooming appliance is configured to have an operation to facilitate grooming of hair. The electric hair grooming appliance generally comprises a control circuit, and a touchscreen for receiving at least one input from a user and to facilitate communication between the user and the control circuit. The touchscreen is configured to send at least one command signal to the control circuit in response to receiving the at least one input from the user. The control circuit is adapted to control the operation of the electric hair grooming appliance in response to receiving the at least one command signal.

BRIEF DESCRIPTION OF THE DRAWINGS

Corresponding reference characters indicate corresponding parts throughout the drawings.

DETAILED DESCRIPTION OF THE DRAWINGS

Figure 1:
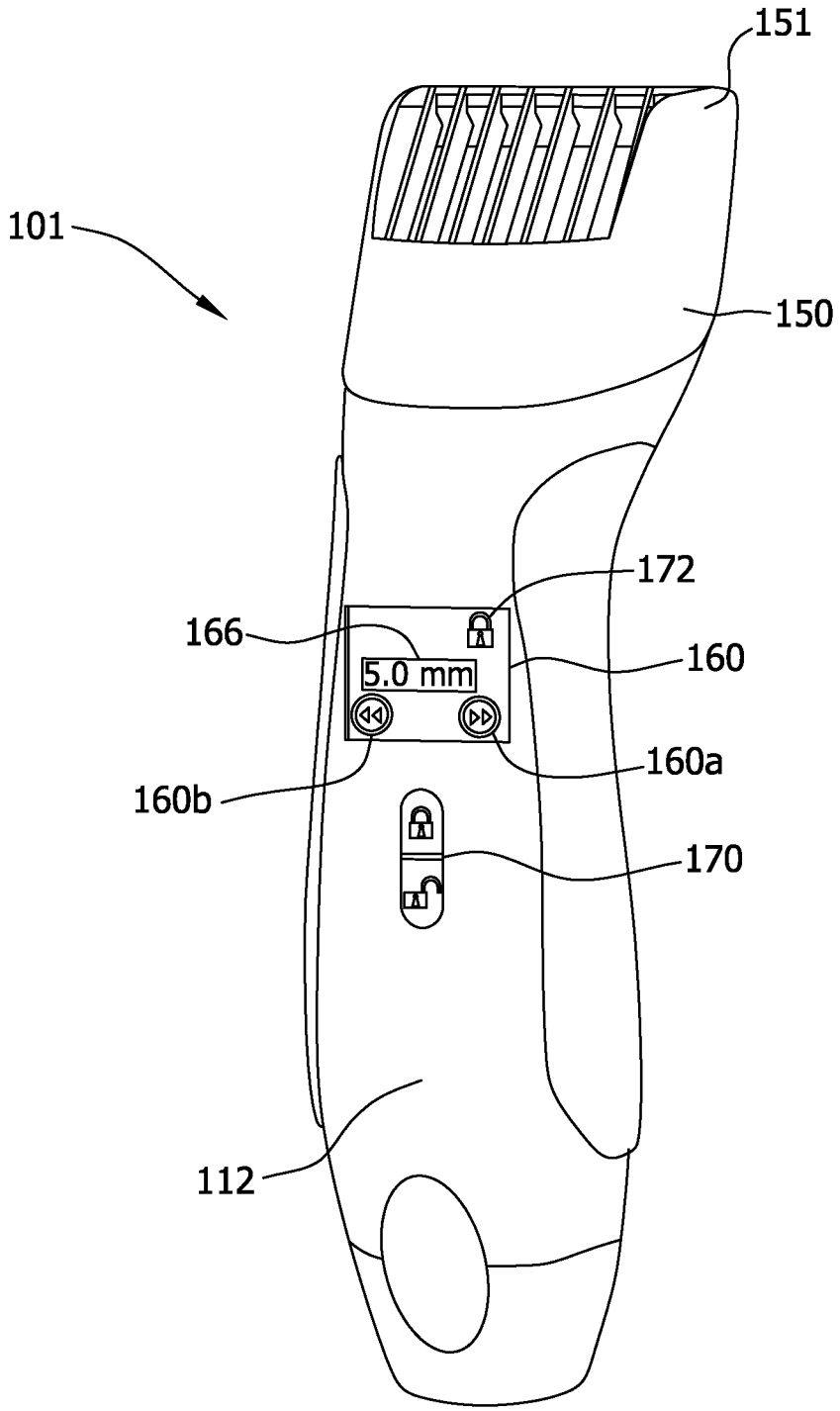
FIG. 1 is a perspective view of a first embodiment of an electric hair grooming appliance including a touchscreen.

Referring to the drawings, several embodiments of electric hair grooming appliances are provided. As explained in more detail below, each illustrated hair grooming appliance is configured to have at least one operation which facilitates grooming of hair. Each illustrated hair grooming appliance includes a touchscreen to allow a user to communicate with a control circuit of the hair grooming appliance. The touchscreen is configured to receive an input from a user and send a command signal to the control circuit. The control circuit is configured to control one or more operations of the hair grooming appliance in response to receiving the command signal.

Figure 2:
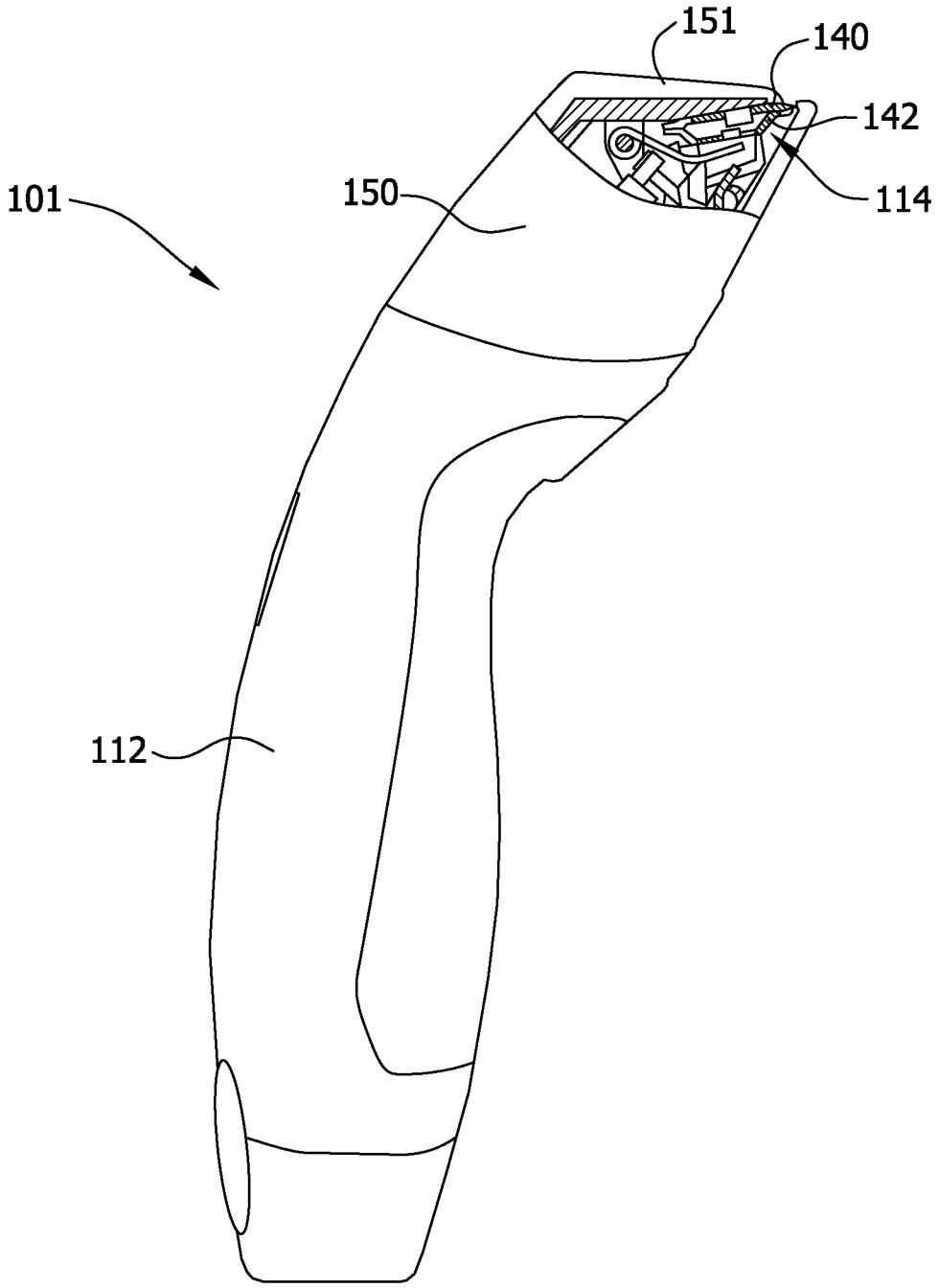
FIG. 2 is a right elevational view of the electric hair grooming appliance of FIG. 1.
Figure 3:
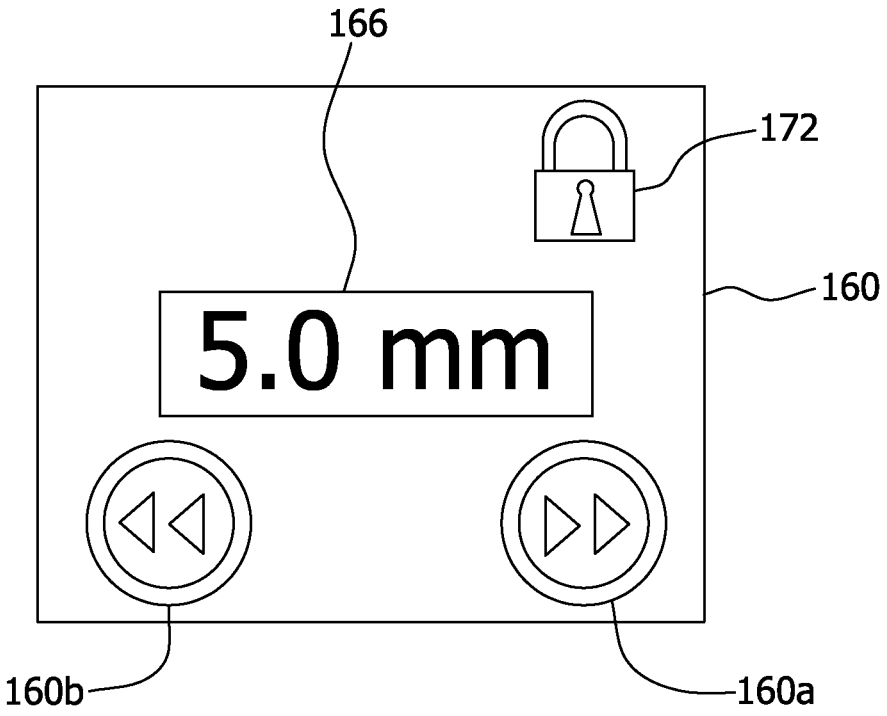
FIG. 3 is an enlarged front elevational view of the touchscreen of the electric hair grooming appliance of FIG. 1.

Referring first to FIGS. 1-3, in this illustrated embodiment the electric hair grooming appliance is generally in the form of a hair removing appliance, generally indicated at 101. More specifically, the illustrated hair removing appliance 101 is generally in the form of a hair trimmer including a housing 112, a blade head assembly (broadly, a hair-removing assembly), indicated generally at 114 (FIG. 2), and a drive assembly (not shown) for operating the blade head assembly. Together, the blade head assembly and drive assembly constitute a hair-removing device (broadly, a hair grooming device). The illustrated housing 112, or a portion thereof, is suitably sized and shaped as a handle so that it is easily held in a user's hand. The drive assembly generally comprises an electric drive motor (not shown) or other electric device. The drive motor may be powered by one or more batteries within the housing and/or by another suitable internal or external electrical power source. Referring to FIG. 2, the blade head assembly 114 generally comprises a stationary blade 140 and a reciprocating blade 142 (broadly, a hair-removing member). The drive assembly 116 is configured to drive reciprocating motion of the reciprocating blade 142 relative to the stationary blade 140. Such reciprocating motion of the reciprocating blade 142 cuts hair disposed between the blades. The trimmer 101 may be of other configurations without departing from the scope of the present invention.

The illustrated trimmer 101 also includes an adjustable comb assembly 150 (broadly, a hair grooming device), including a comb 151 that is selectively movable relative to the blade head assembly 114 through operation of a comb-driving assembly 154 (illustrated schematically in FIG. 4) within the housing. The comb assembly 150 allows a user to control a hair cut-length setting of the trimmer, which corresponds to the length of hair after being cut. The comb-driving assembly 154 may include an electric drive motor or other electrical device, and a transmission mechanism (not shown) coupling the motor to the comb to drive movement of the comb 151 to a plurality of different hair cut-length settings. The comb 151 may be selectively positionable to a discrete number of predetermined hair cut-length settings, or the comb assembly may be positionable to an infinite number of hair cut-length settings. It is understood that the trimmer 101 may not include a comb assembly without departing from the scope of the present invention. Moreover, the trimmer 101 may include other hair grooming devices, in addition to or in lieu of one or both of the illustrated hair grooming devices set forth above.

Figure 4:
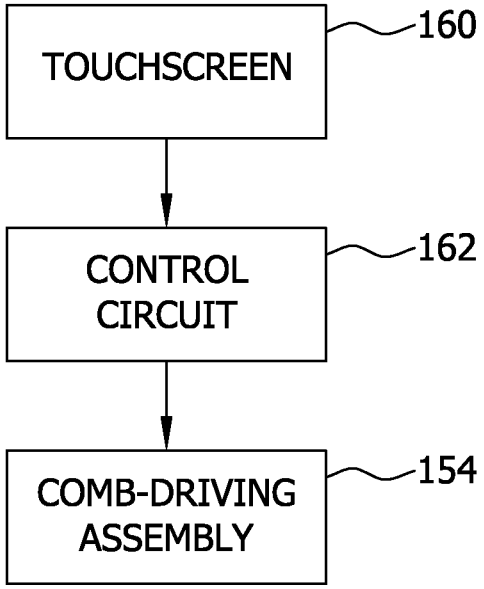
FIG. 4 is a block diagram of a first embodiment of a system of the electric hair grooming appliance of FIG. 1, including the touchscreen, a control circuit, and a comb-driving assembly.

Referring to FIGS. 1, 3 and 4 and as set forth above, the trimmer 101 includes a touchscreen, generally indicated at 160, to allow a user to control one or more operations of the trimmer. The touchscreen 160 is in electrical communication with a control circuit 162, which is disposed in the housing 112. The control circuit 162 may include a single controller (e.g., microcontroller), one or more controllers (e.g., microcontrollers), or one or more other electrical devices (e.g., processor, memory, and input/output peripherals) in communication with one another. In one embodiment, illustrated schematically in FIG. 4, the touchscreen 160 provides a user interface for a user to communicate with the control circuit 162 so that the user can select a desired hair cut-length setting of the trimmer 101. Thus, the touchscreen 160 is adapted to receive one or more inputs from the user. The touchscreen 160 may be any suitable type of touchscreen, including but not limited to a resistive touchscreen, a surface acoustic wave (SAW) touchscreen, a surface capacitance touchscreen, a projected capacitance touchscreen, an infrared touchscreen, an optical imaging touchscreen, a dispersive technology touchscreen, and an acoustic recognition touchscreen. The touchscreen 102, or another screen, may function as an output interface having a visual indicator indicative of the operation controlled by the touchscreen.

As seen in FIGS. 1 and 3, in the illustrated embodiment, the touchscreen 160 generates graphical inputs, such as icons in the form of right and left arrows 160*a*, 160*b*, respectively, to indicate the input locations on the touchscreen to respectively increase and decrease the cut-length setting. The icons 160*a*, 160*b* may be of other configurations and/or of other symbols without departing from the scope of the present invention. In response to a finger or other object (e.g., a stylus) touching the location on the touchscreen 160 corresponding to the right arrow icon 160*a* (i.e., in response to an input by the user), the touchscreen sends a first command signal to the control circuit 162. In response to receiving the command signal, the control circuit 162 sends an electrical first control signal to the comb-driving assembly 154. The comb-driving assembly 154, in turn, moves the comb 151 a predetermined amount relative to the blade head assembly 114 to increase the cut-length setting by a predetermined increment in response to receiving the electrical first control signal. In response to a finger or other object (e.g., a stylus) touching the location on the touchscreen 160 corresponding to the left arrow icon 160*b* (i.e., in response to an input by the user), the touchscreen sends a different, second command signal to the control circuit 162. In response to receiving the second command signal, the control circuit 162 sends a different, electrical second control signal to the comb-driving assembly 154. The comb-driving assembly 154, in turn, moves the comb 151 a predetermined amount relative to the blade head assembly 114 to decrease the cut-length setting by a predetermined increment in response to receiving the electrical second control signal. In an alternative embodiment, indicia including up and down arrow markings may be applied to the surface of the touchscreen instead of the touchscreen generating graphical icons.

The illustrated touchscreen 160 also generates graphical output 166 to communicate the selected hair-cut length setting to the user. In one example, the trimmer 101 may have hair cut-length settings ranging from about 0.2 mm to about 5.0 mm, in increments of about 0.2 mm. Thus, the graphical output 166 is able to output any numeral from 0.2 mm to 5.0 mm, in increments of 0.2 mm. The trimmer 101 may have other hair cut-length settings without departing from the scope of the present invention. Moreover, the output communicating the hair-cut length setting may be separate from the touchscreen 160 without departing from the scope of the present invention.

In the illustrated embodiment, the trimmer 101 also includes a locking control 170 (FIG. 1) for selectively locking the touchscreen 160 to prevent inadvertent adjustment of the hair cut-length setting, and to facilitate selective unlocking of the touchscreen to allow adjustment of the hair cut-length setting. In particular, the locking control 170 of the illustrated embodiment comprises one or more mechanical push buttons or other mechanical switches. The push button 170 has indicia indicating its functions of selectively locking and unlocking the touchscreen 160. The touchscreen 160 may generate one or more icons, such as locking icon 172 for indicating when the touchscreen is locked. In another example, the touchscreen 160 may generate one or more graphical icons to indicate the location(s) on the touchscreen to respectively lock and unlock the touchscreen. Other ways of providing a way of locking and unlocking the touchscreen 160 do not depart from the scope of the present invention.

Figure 5:
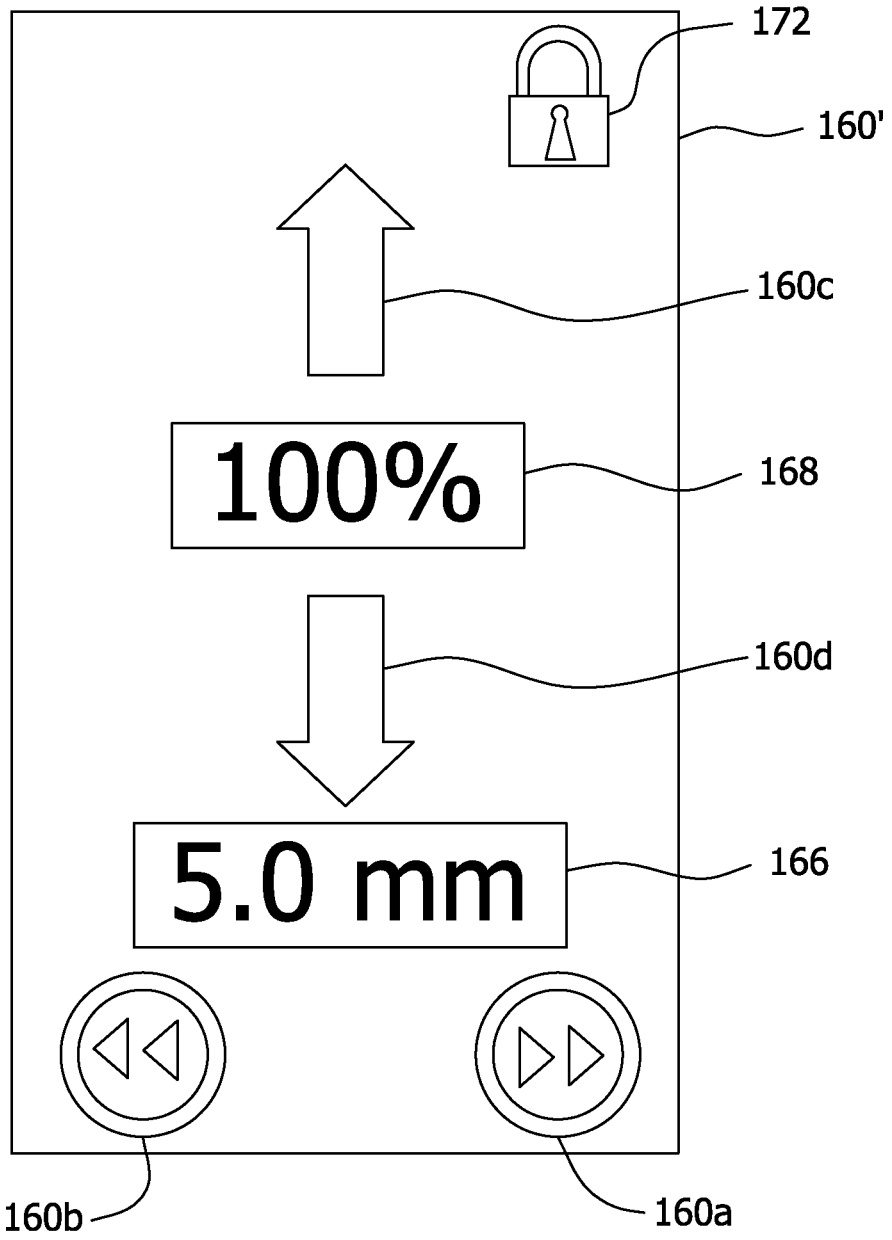
FIG. 5 is an enlarged front elevational view of a second embodiment of the touchscreen of the electric hair grooming appliance of FIG. 1.
Figure 6:
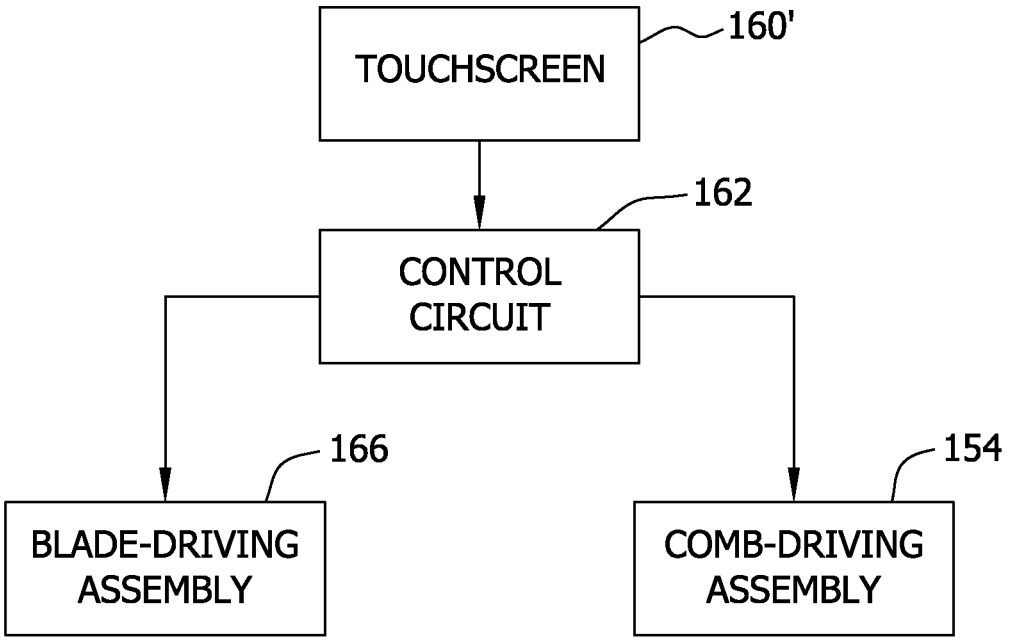
FIG. 6 is a block diagram of a second embodiment of a system of the electric hair grooming appliance of FIG. 1, including the touchscreen, the control circuit, the comb-driving assembly, and a blade-driving assembly.

The touchscreen 160 may also be configured to facilitate control of other operations of the trimmer 101 in addition to or in lieu of controlling the movement and positioning of the comb 151 relative to the blade head assembly 114. For example, FIG. 5 depicts an exemplary second embodiment of a touchscreen 160' for use on a trimmer. This touchscreen 160' allows the user to adjust a speed-setting of the reciprocating blade 142, as well as control the hair cut-length setting, such at set forth above. In such an example, the touchscreen 160' may generate graphical inputs, such as icons in the form of up and down arrows 160*b*, 160*c*, respectively, or other symbols, in addition to the left and right arrows for controlling the hair cut-length setting. In response to the user touching the respective locations on the touchscreen 160' corresponding to the respective up and down arrow icons, 160*c*, 160*d*, the touchscreen sends respective third and fourth command signals to the control circuit 162. The control circuit 162, in response to receiving the respective third and fourth command signals, sends respective third and fourth control signals to the drive assembly, illustrated schematically at 166 in FIG. 6, to respectively increase and decrease the speed of the reciprocating blade 142 by a selected increment to a selected speed-setting. The selected speed-setting may be communicated to the user as a graphical output 168, which may represent a percentage of the full speed of the reciprocating blade. Other ways of communicating the selected speed-setting to the user do not depart from the scope of the present invention.

Within the scope of the present invention are other types of hair removing appliances including a touchscreen, which may be similar or identical to the touchscreen 160 and/or 160' set forth above, to allow a user to communicate with a control circuit of the hair removing appliance. As non-limiting examples, other types of hair removing appliances within the scope of the present invention include foil shavers, rotary shavers, hair clippers, and epilators. Within the scope of the present invention, each of these hair removing appliances includes the touchscreen (e.g., touchscreen 160 or 160') in communication with a control circuit; a drive assembly including, for example, an electric motor, which is driven by electric energy such as from a battery source or another source of electrical energy; and a movable hair-removing member (e.g., a rotary blade in the rotary shaver, an oscillating blade in the hair clipper, and pinching plates and/or tweezing members in the epilator) operatively coupled to the electric motor and configured for removing hair. Each of these exemplary hair removing appliances may include other hair grooming devices in addition to the hair grooming device comprising the hair-removing member and the drive assembly. In each of these additional exemplary hair removing appliances, the control circuit is configured to receive a command signal from the touchscreen in response to an input, and in response to receiving the command signal, the control circuit controls an operation of at least one of the hair grooming devices of the hair removing appliance by sending a control signal to the hair grooming device For example, in each of the exemplary hair removing appliances described herein, the control circuit may be configured to control the speed of the corresponding movable hair-removing member.

Figure 7:
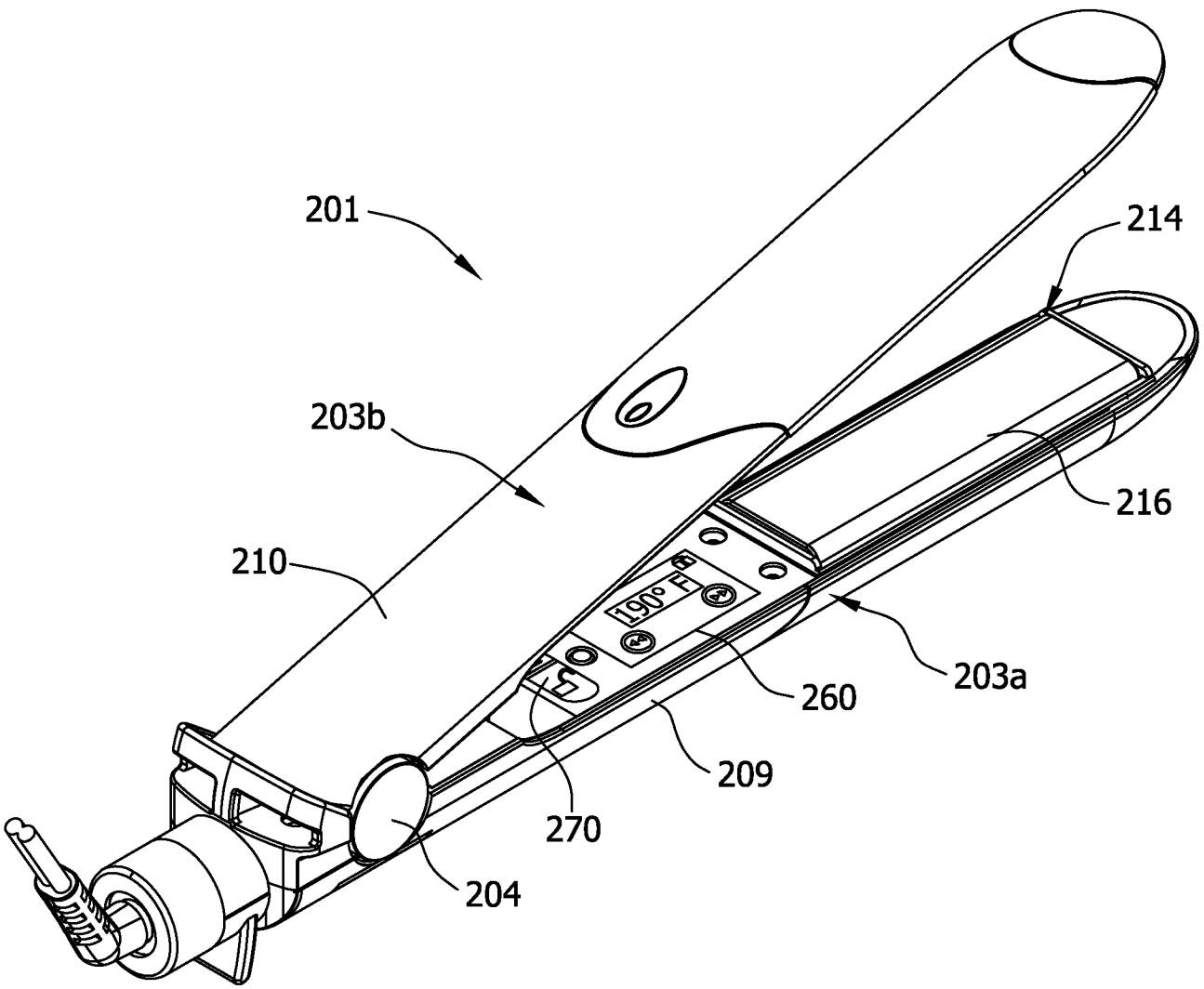
FIG. 7 is a perspective view of a second embodiment of an electric hair grooming appliance including a touchscreen.

Referring now to FIGS. 7-10 a second embodiment of an electric hair grooming appliance including a touchscreen is generally indicated at 201 (FIG. 7). In general, this embodiment 201 is adapted to apply heat to hair, as explained in more detail below, and more specifically, the illustrated hair styling apparatus is in the form of a flat iron. The illustrated flat iron 201 is generally elongate with opposite longitudinal ends and has first and second arms, generally indicated at 203*a* and 203*b*, respectively, held in assembly with each other by a suitable pivot connection 204 at one of the longitudinal ends of the flat iron. The first and second arms 203*a*, 203*b* are thus moveable relative to one another and about a pivot axis of the pivot connection 204 between an open position (FIG. 7) of the flat iron 201 and a closed position (not illustrated) thereof. A biasing member in the form of a compression spring (not shown) is suitably positioned between the first and second arms 203*a*, 203*b* adjacent to the pivot connection 204 to urge the arms toward the open position of the flat iron 201.

Figure 8:
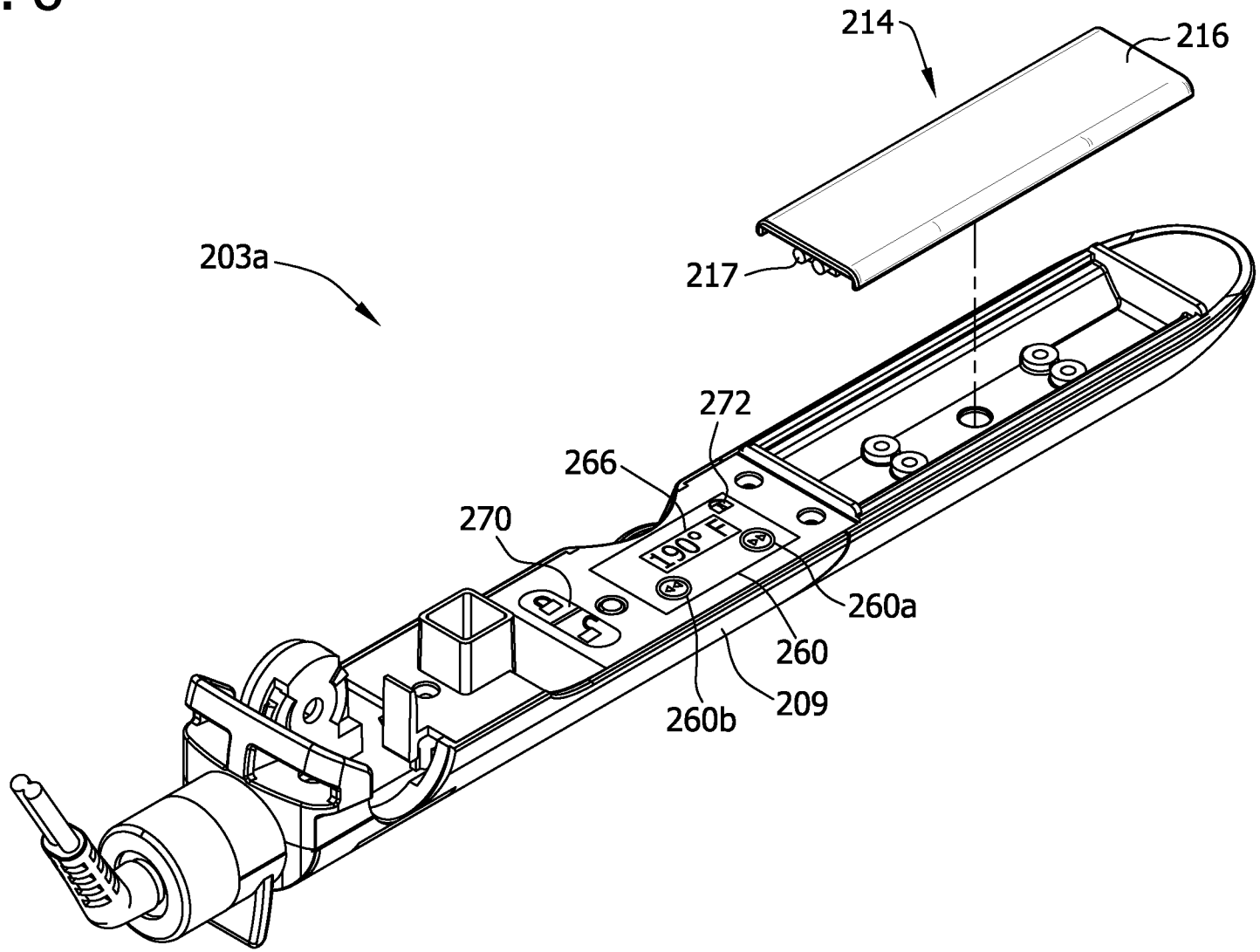
FIG. 8 is an enlarged, perspective view of a lower arm of the electric hair grooming appliance of FIG. 7, with a heating member assembly exploded therefrom.
Figure 9:
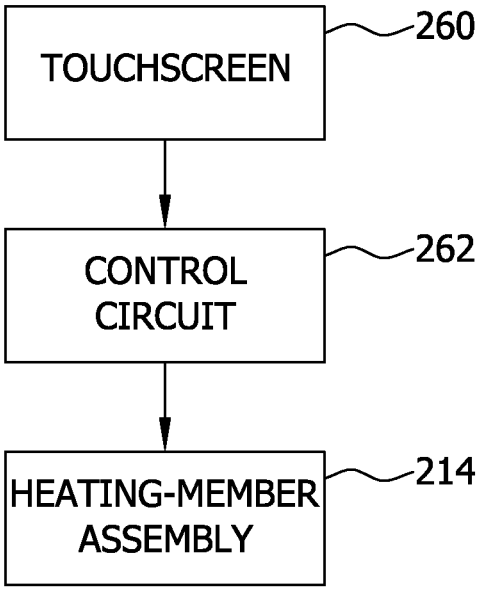
FIG. 9 is a block diagram of a first embodiment of a system of the electric hair grooming appliance of FIG. 7, including the touchscreen, a control circuit, and a heating member assembly.
Figure 10:
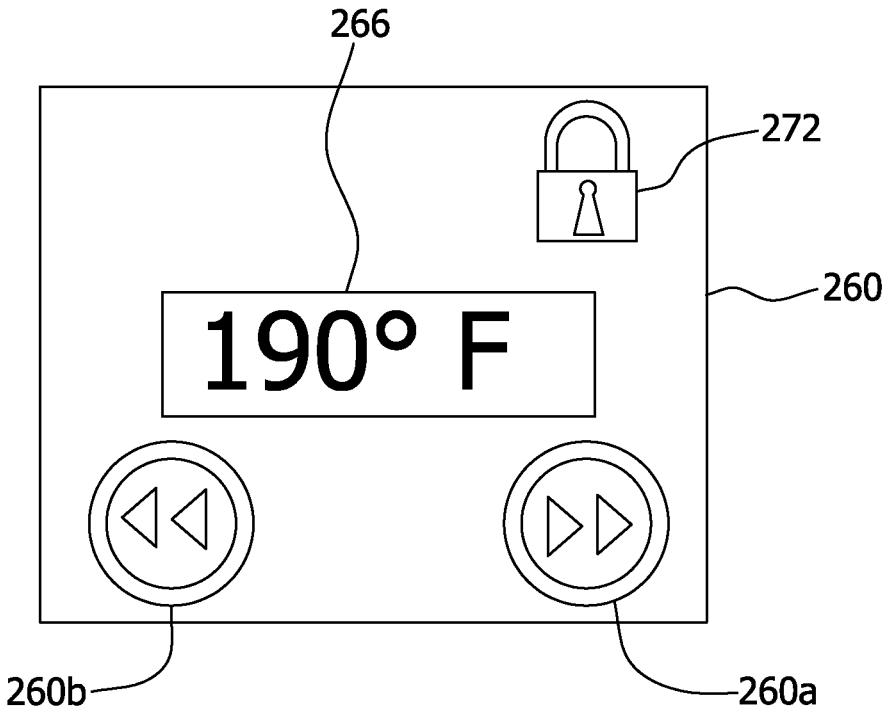
FIG. 10 is an enlarged front elevational view of the touchscreen of the electric hair grooming appliance of FIG. 7.

Each of the first and second arms 203*a*, 203*b* comprises an outer shell or housing member 209, 210, respectively, and a heating member assembly secured thereto (only heating member assembly 214 associated with the first arm is illustrated). The heating member assemblies 214 of the first and second arms 203*a*, 203*b* may be substantially identical, and for ease of description only, the heating member assembly of the first arm only is described herein, with the understanding that the description of the heating member assembly of the first arm may apply equally to the heating member assembly of the second arm. Referring to FIG. 8, the heating member assembly 214 comprises a thermally conductive heating member 216, which may be constructed of any suitable material, such as, without limitation, metal, ceramic materials or combinations thereof; a heating unit 217 disposed within the housing member 209; and a temperature sensing unit (not shown), which may include a thermistor and heat conductor in thermal contact with the heating unit (or heating member) and the thermistor.

The heating unit 217 suitably comprises one or more heaters, such as electrical resistance heaters (e.g., PTC heating units), positioned in contact with or in sufficiently close proximity to the heating member 216 to heat the heating member during use of the flat iron 201. For example, in one suitable embodiment the heating unit 217 is operable to heat the heating member 216 to a styling temperature of at least about 100 degrees Celsius, and may heat the heating member up to a temperature of about 250 degrees Celsius. In another embodiment the heating unit 217 is operable to heat the heating member 216 to a styling temperature in the range of about 180 to about 230 degrees Celsius. It is understood that other suitable heating units or heating methods may be used to heat the heating member 216 without departing from the scope of this invention.

The heating members 216 of the respective heating member assemblies 214 of the first and second arms 203*a*, 203*b* are sufficiently located longitudinally on the respective arms so that in the closed position of the flat iron 201 the heating members 214 sandwich and compress hair therebetween. In the open position of the flat iron 201, the heating members 216 are spaced apart from one another a sufficient distance to allow the introduction of hair between the heating members.

As set forth above and seen throughout FIGS. 7-10, the flat iron 201 includes a touchscreen, generally indicated at 260, to allow a user to control one or more operations of the flat iron. The touchscreen 260 is in electrical communication with a control circuit 262, which is disposed in one of the housing members 209, 210. In one embodiment, illustrated schematically in FIG. 9, the touchscreen 260 provides a user interface for a user to communicate with the control circuit 262 so that the user can select a desired temperature setting of the flat iron 201, more specifically, a temperature setting of the heating member assemblies 214. Thus, the touchscreen 260 is adapted to receive one or more inputs from the user. The touchscreen 260 may be any suitable type of touchscreen, including but not limited to a resistive touchscreen, a surface acoustic wave (SAW) touchscreen, a surface capacitance touchscreen, a projected capacitance touchscreen, an infrared touchscreen, an optical imaging touchscreen, a dispersive technology touchscreen, and an acoustic recognition touchscreen. The touchscreen 260, or another screen, may function as an output interface to communicate to the user the selected temperature setting.

In one embodiment, the touchscreen 260 generates graphical inputs, such as icons in the form of right and left arrows 260*a*, 260*b*, respectively (FIGS. 8 and 10), to indicate the locations on the touchscreen to respectively increase and decrease the temperature setting. The icons 260*a*, 260*b* may be of other configurations and/or of other symbols without departing from the scope of the present invention. In response to a finger or other object (e.g., a stylus) touching the location on the touchscreen 260 corresponding to the right arrow icon 260*a* (i.e., in response to an input by the user), the touchscreen sends a first command signal to the control circuit 262. In response to receiving the first command signal, the control circuit 262 sends an electrical first control signal to the heating member assemblies 214 (e.g., to the PTC heating units 217), which increases the heat output of the heating units 217 to increase the temperatures of the heating members 216 by a predetermined increment. Moreover, in response to a finger or other object (e.g., a stylus) touching the location on the touchscreen 260 corresponding to the left arrow icon 260*b*

(i.e., in response to an input by the user), the touchscreen sends a different second command signal to the control circuit 262. In response to receiving the second command signal, the control circuit 262 sends a different, second electrical control signal to the heating member assemblies 214, which decreases the heat output of the heating units 217 to decrease the temperatures of the heating members 216 by a predetermined increment. In an alternative embodiment, indicia, including right and left arrow markings, may be applied to a surface of the touchscreen instead of the touchscreen generating the icons.

The illustrated touchscreen 260 also generates graphical output 266 to communicate the selected temperature setting, or other selected operation, to the user. It is understood, however, that the output communicating the temperature setting to the user may be separate from the touchscreen 260, such as on a separate display screen, without departing from the scope of the present invention.

The touchscreen 260 may also be configured to facilitate control of other operations of the flat iron 201 in addition to or in lieu of controlling the temperatures of the heating members 216.

In the illustrated embodiment, the flat iron 201 also includes a locking control 270 for selectively locking the touchscreen 260 to prevent inadvertent adjustment of the temperature setting, and to facilitate selective unlocking of the touchscreen to allow adjustment of the temperature setting. In particular, the locking control 270 of the illustrated embodiment comprises one or more push buttons or other mechanical switches. The push button 270 has indicia indicating its functions of selectively locking and unlocking the touchscreen 260. The touchscreen 260 may generate one or more icons, such as icon 272, for indicating when the touchscreen is locked and/or unlocked. In another example, the touchscreen 260 may generate one or more icons to indicate the location(s) on the touchscreen to respectively lock and unlock the touchscreen. Other ways of providing a way of locking and unlocking the touchscreen 260 do not depart from the scope of the present invention.

Within the scope of the present invention are other types of hair styling appliances for applying heat to hair and including a touchscreen, such as the touchscreen 260 set forth above, to allow a user to communicate with a control circuit of the hair styling appliance. As non-limiting examples, other types of hair styling appliances within the scope of the present invention include curling irons, blow dryers, and hair setters (also known as hot rollers). Within the scope of the present invention, each of these hair styling appliances includes the touchscreen in communication with a control circuit; and a heating member assembly, which is heated by electric energy such as from a battery source or another source of electrical energy. In each of these exemplary hair removing appliances, the control circuit is configured to receive a command signal from the touchscreen in response to an input, and in response to receiving the command signal, the control circuit controls an operation of the hair removing appliance. For example, in each of the exemplary hair removing appliances set forth, the control circuit may be configured to control the temperature of the heating member assembly. With respect to an exemplary blow dryer, the touchscreen may allow the user to control the speed of the fan, in addition to the temperature of the air.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An electric, handheld hair grooming appliance comprising:

a housing;

at least one hair grooming device adapted to facilitate grooming hair, said at least one hair grooming device comprising a movable comb;

a comb-driving assembly operatively coupled to the comb for moving the comb to a selected hair cut-length setting of the hair grooming appliance;

a control circuit in the housing for operating said at least one hair grooming device; and a touchscreen on at least one of the at least one hair grooming device and the housing for receiving at least one input from a user to facilitate communication between the user and the control circuit, the touchscreen being configured to send at least one command signal to the control circuit in response to receiving said at least one input from the user, wherein the control circuit is configured to control said movement of the at least one hair grooming device in response to receiving said at least one command signal such that the user is able to operate the at least one hair grooming device using the touchscreen, and wherein the touchscreen is configured to receive a first input of said at least one input from the user and send a first command signal of said at least one command signal to the control circuit in response to receiving said first input, and wherein the touchscreen is configured to receive a second input of said at least one input from the user and send a second command signal of said at least one command signal to the control circuit in response to receiving said second input, the control circuit being configured to control the comb-driving assembly to move the comb to increase the cut-length setting of the hair grooming appliance in response to receiving said first command signal, and configured to control the comb-driving assembly to move the comb to decrease the hair cut-length setting of the hair grooming appliance in response to receiving said second command signal.

2. An electric hair grooming appliance as set forth in claim 1 wherein the touchscreen is configured to generate a first icon for indicating a first location on the touchscreen for receiving the first input, and to generate a second icon for indicating a second location on the touchscreen for receiving the second input.

3. An electric hair grooming appliance as set forth in claim 1 further comprising indicia applied to the touchscreen, the indicia including a first marking for indicating a first location on the touchscreen for receiving the first input, and a second marking for indicating a second location on the touchscreen for receiving the second input.

4. An electric hair grooming appliance as set forth in claim 1 further comprising an electric motor for moving the at least one hair grooming device at a selected speed-setting.

5. An electric hair grooming appliance as set forth in claim 1 wherein the hair grooming appliance comprises a locking control for selectively locking the touchscreen.

6. An electric, handheld hair grooming appliance comprising:

a housing;

at least one hair grooming device adapted to facilitate grooming hair, said at least one hair grooming device comprising one of a movable hair cutting blade and a movable hair pinching plate;

a drive assembly operatively coupled to one of the hair cutting blade and the hair pinching plate;

a control circuit in the housing for operating said at least one hair grooming device; and a touchscreen on at least one of the at least one hair grooming device and the housing for receiving at least one input from a user to facilitate communication between the user and the control circuit, the touchscreen being configured to send at least one command signal to the control circuit in response to receiving said at least one input from the user, wherein the control circuit is configured to control said movement of the at least one hair grooming device in response to receiving said at least one command signal such that the user is able to operate the at least one hair grooming device using the touchscreen, and wherein the touchscreen is configured to receive a first input of said at least one input from the user and send a first command signal of said at least one command signal to the control circuit in response to receiving said first input, and wherein the touchscreen is configured to receive a second input of said at least one input from the user and send a second command signal of said at least one command signal to the control circuit in response to receiving said second input, the control circuit being configured to control the drive assembly to decrease the speed of the one of the blade and the plate in response to receiving said first command signal, and adapted to control the drive assembly to increase the speed of the one of the blade and the plate in response to receiving said second command signal.

7. An electric hair grooming appliance as set forth in claim 6 wherein the touchscreen has a first icon for indicating a first location on the touchscreen for receiving the first input, and a second icon for indicating a second location on the touchscreen for receiving the second input.

* * * * *